US009476571B2

(12) United States Patent
Takatori

(10) Patent No.: US 9,476,571 B2
(45) Date of Patent: Oct. 25, 2016

(54) LIGHTING APPARATUS

(71) Applicant: Enplas Corporation, Saitama (JP)

(72) Inventor: Hiroshi Takatori, Saitama (JP)

(73) Assignee: Enplas Corporation, Saitama (JP)

( * ) Notice: Subject to any disclaimer, the term of this patent is extended or adjusted under 35 U.S.C. 154(b) by 216 days.

(21) Appl. No.: 14/086,087

(22) Filed: Nov. 21, 2013

(65) Prior Publication Data

US 2014/0140051 A1 May 22, 2014

(30) Foreign Application Priority Data

Nov. 22, 2012 (JP) ..... 2012-255940

(51) Int. Cl.

| | |
|---|---|
| ***F21V 13/04*** | (2006.01) |
| ***F21V 3/04*** | (2006.01) |
| ***F21V 5/02*** | (2006.01) |
| *F21V 5/00* | (2015.01) |
| *F21V 7/00* | (2006.01) |
| *F21V 7/04* | (2006.01) |
| *F21Y 101/02* | (2006.01) |

(52) U.S. Cl.

CPC ..... *F21V 13/04* (2013.01); *F21V 3/049* (2013.01); *F21V 5/02* (2013.01); *F21V 5/008* (2013.01); *F21V 7/0033* (2013.01); *F21V 7/043* (2013.01); *F21Y 2101/02* (2013.01)

(58) Field of Classification Search

CPC ..... F21V 13/04; F21V 7/005; F21V 7/043; F21V 3/049; F21V 5/02; F21V 5/008; F21V 7/0033; F21Y 2101/02; F21Y 2103/00

USPC ..... 362/551, 552, 555, 558, 560, 311, 362/217.01, 217.02, 217.04, 217.05, 249.02

See application file for complete search history.

(56) References Cited

U.S. PATENT DOCUMENTS

| | | | | |
|---|---|---|---|---|
| 3,115,309 | A * | 12/1963 | Spencer | F21S 48/119 313/110 |
| 7,478,936 | B2 * | 1/2009 | Chen | F21S 8/031 362/555 |
| 7,565,050 | B2 * | 7/2009 | Lee | G02B 6/0096 362/551 |
| 8,231,256 | B1 * | 7/2012 | Coleman | F21V 7/043 362/231 |
| 2009/0284982 | A1 * | 11/2009 | Cho | G02B 5/045 362/551 |
| 2009/0290373 | A1 * | 11/2009 | Shin | G02B 5/0215 362/558 |
| 2010/0053977 | A1 * | 3/2010 | Chen | F21K 9/00 362/310 |
| 2010/0110678 | A1 | 5/2010 | Shen et al. | |
| 2010/0148650 | A1 * | 6/2010 | Wu | F21K 9/135 313/1 |
| 2012/0044666 | A1 * | 2/2012 | Buelow | H05B 33/0803 362/85 |
| 2013/0141903 | A1 * | 6/2013 | Rivas | F21V 13/04 362/218 |
| 2013/0182433 | A1 | 7/2013 | Okazaki et al. | |

(Continued)

FOREIGN PATENT DOCUMENTS

| | | |
|---|---|---|
| JP | 63-228513 A | 9/1988 |
| JP | 2002-237203 A | 8/2002 |

(Continued)

*Primary Examiner* — Renee Chavez
*Assistant Examiner* — Christopher E Dunay
(74) *Attorney, Agent, or Firm* — Brundidge & Stanger, P.C.

(57) ABSTRACT

A lighting apparatus includes a light emitting element, a light flux controlling member which controls light distribution so as to narrow the light emitted from the light emitting element, a substantially tubular prism member which is formed of an optically-transparent material, has a plurality of prism rows, and extends in the optical axis direction, and a substantially tubular diffusion member having optical transparency and a light diffusion property. The plurality of prism rows is disposed parallel to the optical axis on the outer peripheral surface of the prism member.

6 Claims, 13 Drawing Sheets

(56) References Cited

U.S. PATENT DOCUMENTS

2013/0329444 A1* 12/2013 Oh ..... F21V 21/00
362/543
2013/0343079 A1* 12/2013 Unger ..... F21K 9/52
362/555

FOREIGN PATENT DOCUMENTS

| | | | |
|---|---|---|---|
| JP | 2009-169157 | A | 7/2009 |
| JP | 3153406 | U | 9/2009 |
| JP | 2011-187165 | A | 9/2011 |
| WO | 2012/077269 | A1 | 6/2012 |

* cited by examiner

LIGHTING APPARATUS

CROSS REFERENCE TO RELATED APPLICATIONS

This application is entitled and claims the benefit of Japanese Patent Application No. 2012-255940, filed on Nov. 22, 2012, the disclosure of which including the specification, drawings and abstract is incorporated herein by reference in its entirety.

TECHNICAL FIELD

The present invention relates to a lighting apparatus which uses a light emitting element as a light source and can be used in place of a fluorescent tube or the like.

BACKGROUND ART

In recent years, with the goal of energy saving or environmental conservation, a lighting apparatus using a light emitting diode (hereinafter also referred to as an "LED") as a light source (for example, an LED bulb, an LED fluorescent tube, or the like) has been used as a lighting apparatus replacing a bulb, a fluorescent tube, or the like (refer to PTL 1, for example).

FIG. 1 is a diagram showing the configuration of lighting apparatus 10 according to PTL 1. As shown in FIG. 1, lighting apparatus 10 according to PTL 1 has light source 20 (a light emitting element) such as an LED, rod-shaped light guide member 30 which is formed of resin or glass and propagates the light emitted from light source 20, and optically-transparent cover 40 which covers light guide member 30. Light guide member 30 is disposed such that an end face (an incidence plane) thereof faces light source 20.

The light emitted from light source 20 is incident on the inside of light guide member 30 from the incidence plane. The light incident on the inside of light guide member 30 is emitted from the outer peripheral surface of light guide member 30 while advancing along an axial direction of light guide member 30, as shown by an arrow in FIG. 1, for example.

CITATION LIST

Patent Literature

PTL 1: Japanese Patent Application Laid-Open No. 2009-169157

SUMMARY OF INVENTION

Technical Problem

As shown in FIG. 1, in lighting apparatus 10 of PTL 1, since the light emitted from light source 20 is incident on light guide member 30 without controlling light distribution of the light, the amount of light which is optically guided to the far side of light guide member 30 when viewed from light source 20 is reduced. Accordingly, there is a problem in that luminance unevenness may occur in the outer peripheral surface (a luminous area) of light guide member 30. Further, since light guide member 30 is formed of resin or glass, there is a problem in that lighting apparatus 10 becomes heavy and thus handling is troublesome.

An object of the present invention is to provide a lighting apparatus in which luminance unevenness in a luminous area is small and which is light in weight.

Solution to Problem

In order to achieve the above-described object, according to an aspect of the invention, there is provided a lighting apparatus including: a light emitting element; a light flux controlling member which is disposed such that a central axis thereof overlaps with an optical axis of the light emitting element, and the light flux controlling member being configured to control a light from the light emitting element so as to narrow light distribution of the light; a substantially tubular prism member which is disposed so as to surround the optical axis including a whole of the light flux controlling member, is formed of an optically-transparent material, has a plurality of prism rows, and extends in the optical axis direction; and a substantially tubular diffusion member which is disposed so as to surround the prism member and has optical transparency and a light diffusion property, wherein the plurality of prism rows is disposed parallel to the optical axis on an outer peripheral surface of the prism member, and light emitted from the light emitting element is emitted through the prism member and the diffusion member.

Advantageous Effects of Invention

According to the invention, it is possible to provide a lighting apparatus in which luminance unevenness in a luminous area is small and which is light in weight.

DESCRIPTION OF EMBODIMENTS

Hereinafter, embodiments according to the invention will be described in detail with reference to the drawings. In the following description, as a representative example of a lighting apparatus according to the invention, a lighting apparatus which can be used in place of a fluorescent tube will be described. In the following description, a lighting apparatus with light emitting elements disposed at both ends will be described.

Embodiment 1

Configuration of Lighting Apparatus

Figure 1:
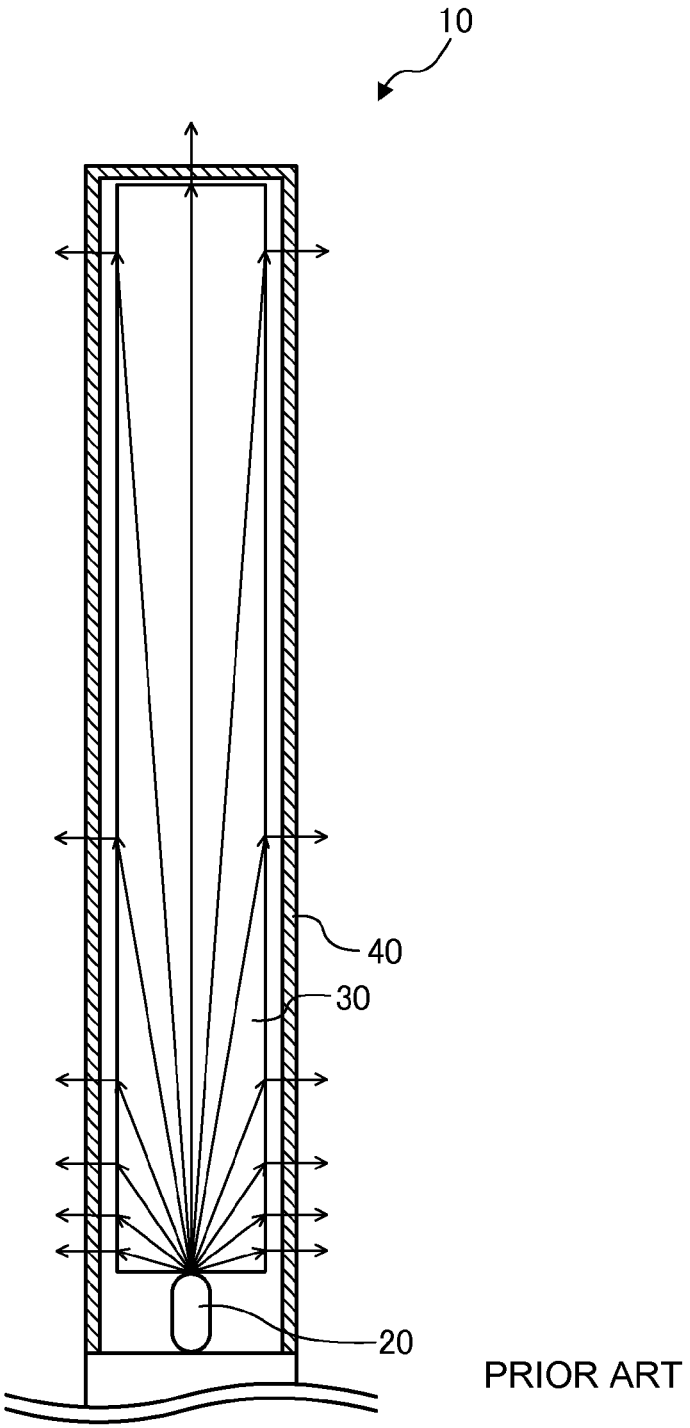
FIG. 1 is a cross-sectional view of a lighting apparatus of PTL 1.
Figure 2A:
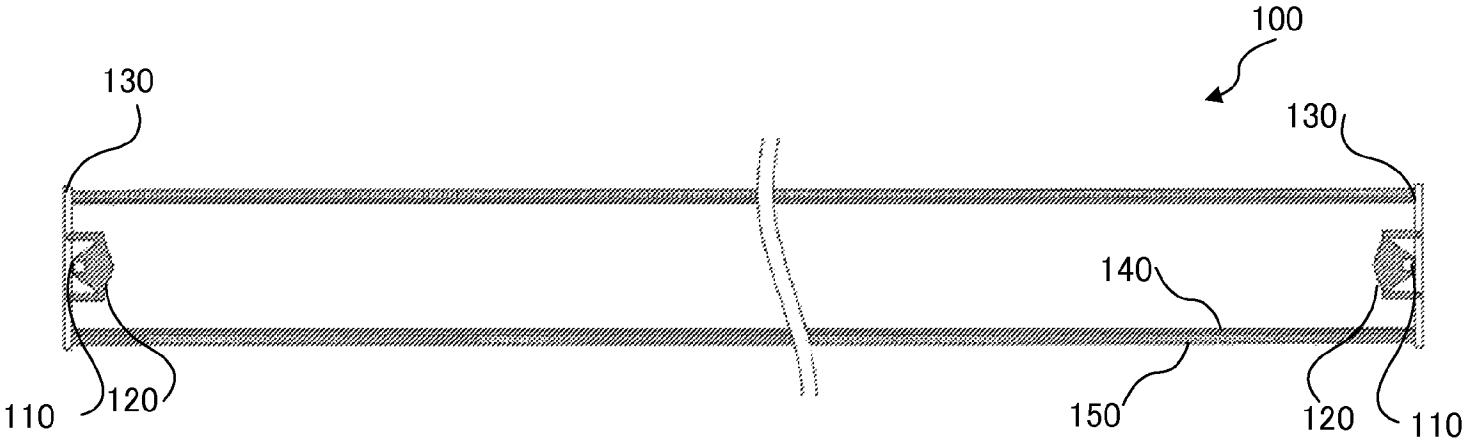
FIGS. 2A and 2B are cross-sectional views of a lighting apparatus according to Embodiment 1.
Figure 2B:
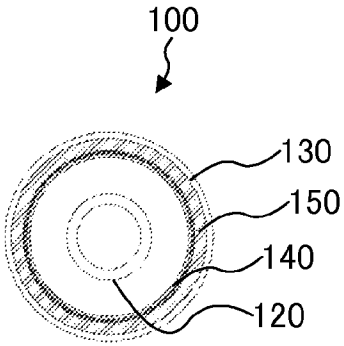
Figure 3:
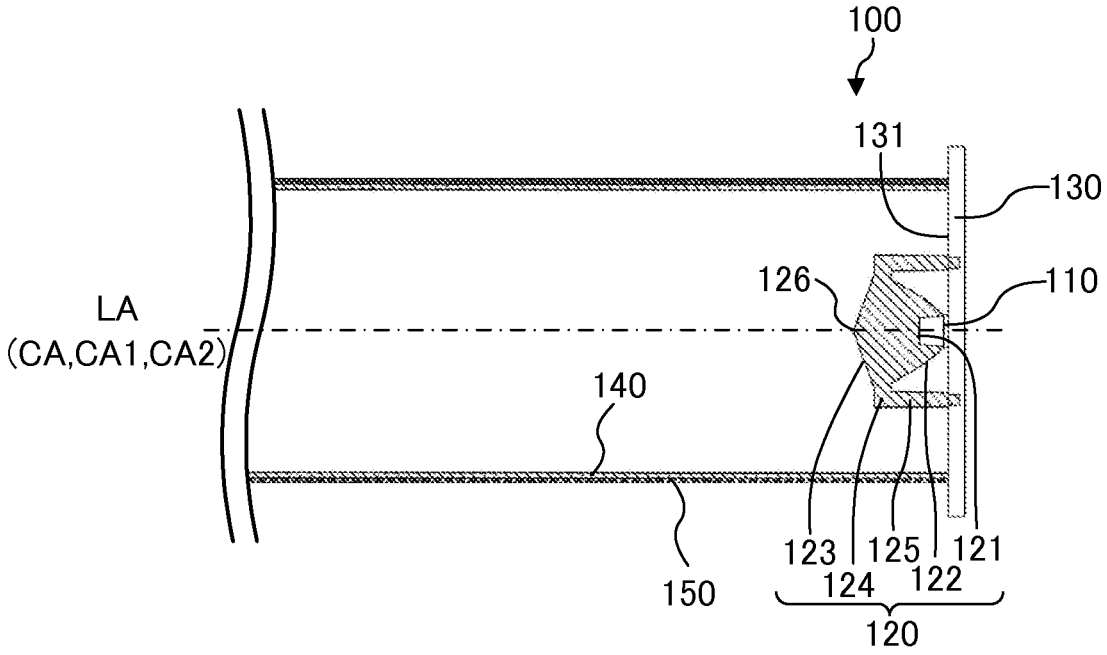
FIG. 3 is a partial enlarged view of FIG. 2A.
Figure 4:
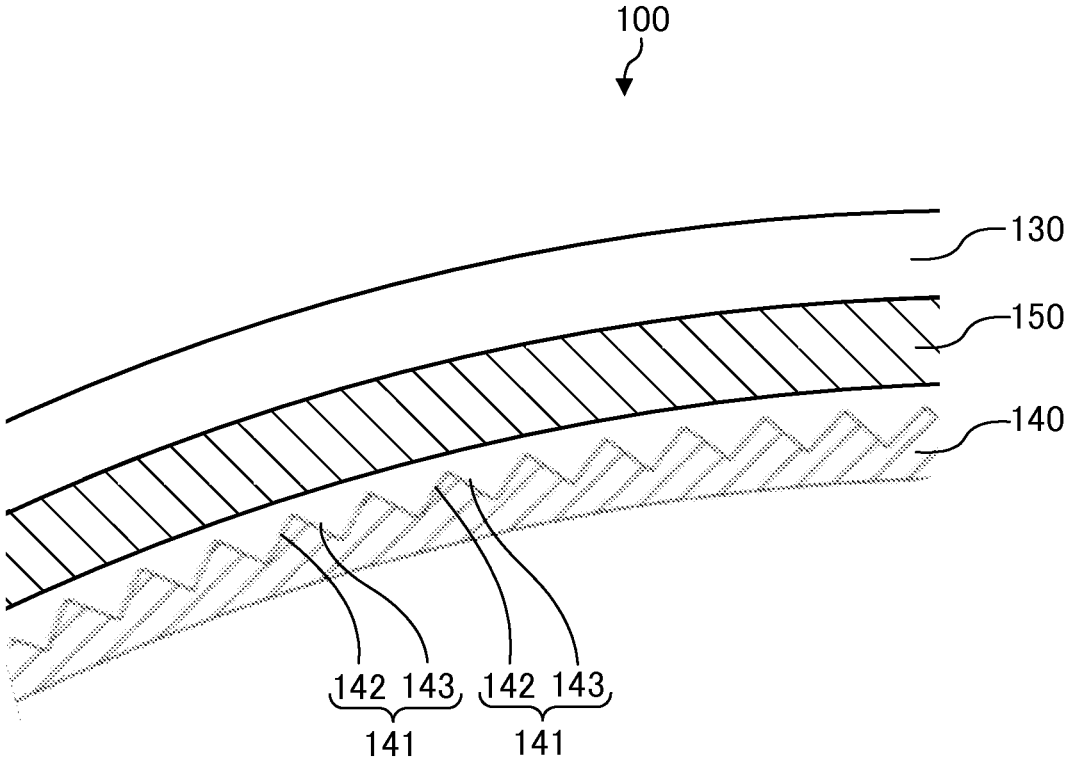
FIG. 4 is a partial enlarged view of FIG. 2B.

FIGS. 2A and 2B are cross-sectional views of lighting apparatus 100 according to Embodiment 1. FIG. 2A is a cross-sectional view in a long axis direction (an optical axis LA direction of light emitting element 110) of lighting apparatus 100, and FIG. 2B is a cross-sectional view in a short axis direction (a direction orthogonal to optical axis LA of light emitting element 110) of lighting apparatus 100. FIG. 3 is a partial enlarged view of FIG. 2A. FIG. 4 is a partial enlarged view of FIG. 2B.

As shown in FIGS. 2A, 2B, and 3, lighting apparatus 100 has light emitting element 110, light flux controlling member 120, substrate 130, prism member 140, and diffusion member 150. Light emitting element 110 and light flux controlling member 120 constitute a light emitting device. Lighting apparatus 100 has one or two or more light emitting devices. In a case of disposing two light emitting devices, the respective light emitting devices may be disposed facing each other such that the light emitting faces of light emitting elements 110 face each other.

Light emitting element 110 is a light source of lighting apparatus 100 and is a light emitting diode (LED) such as a white light emitting diode, for example.

Light flux controlling member 120 is configured to control a light from light emitting element 110 so as to narrow light distribution of the light (makes the light distribution narrower). Light flux controlling member 120 is disposed on substrate 130 such that central axis CA coincides with optical axis LA of light emitting element 110. Here, "optical axis LA of light emitting element 110" means a light beam in the center of a three-dimensional light flux emitted from light emitting element 110.

Light flux controlling member 120 may be formed by injection molding. A material of light flux controlling member 120 is not particularly limited as long as it is a material capable of passing light having a desired wavelength. For example, a material of light flux controlling member 120 is optically-transparent resin such as polymethylmethacrylate (PMMA), polycarbonate (PC), or epoxy resin (EP), or glass.

Light flux controlling member 120 has incidence plane 121, total reflection surface 122, emission surface 123, flange 124, and holder 125. In the following description, the side which faces light emitting element 110 and on which light is incident is referred to as the "back side". The side which does not face light emitting element 110 and emits light is referred to as the "front side". Further, the central axis of total reflection surface 122 that is rotationally symmetrical is defined as "central axis CA of light flux controlling member 120".

Incidence plane 121 makes the light emitted from light emitting element 110 incident on the inside of light flux controlling member 120. Incidence plane 121 is the inner surface of a concave portion formed on the back side (the light emitting element 110 side) of light flux controlling member 120 so as to intersect with central axis CA. Incidence plane 121 is a rotational symmetry plane centered on central axis CA.

Total reflection surface 122 reflects some of the light incident on incidence plane 121 toward emission surface 123 (the front side). Total reflection surface 122 is a surface extending from an outer edge of the bottom of light flux controlling member 120 to an outer edge of emission surface 123. Total reflection surface 122 is basically a rotational symmetry plane formed so as to surround central axis CA. The diameter of total reflection surface 122 gradually increases toward the emission surface 123 side from the incidence plane 121 side. A generatrix configuring total reflection surface 122 (total reflection surface 122 in a cross-sectional view which includes central axis CA) is an arc-shaped curve which is convex to the outside (a side away from central axis CA).

Emission surface 123 emits some of the light incident on incidence plane 121 and the light reflected by total reflection surface 122 to the outside. Emission surface 123 is a surface which is located on the opposite side (the front side) to incidence plane 121 in light flux controlling member 120, and is formed so as to intersect with central axis CA. Emission surface 123 emits some of the light incident on incidence plane 121 and the light reflected by total reflection surface 122 to the outside. Emission surface 123 is a rotational symmetry plane centered on central axis CA, and an intersection point with central axis CA is apex 126 where the height from the back side is the highest.

Holder 125 supports a light flux controlling member main body having incidence plane 121, total reflection surface 122, and emission surface 123 and also positions the light flux controlling member main body with respect to substrate 130. Holder 125 is a substantially cylindrical member. Flange 124 is joined to an upper end portion of holder 125.

Substrate 130 supports light emitting element 110 and light flux controlling member 120. Substrate 130 supports light emitting element 110 and light flux controlling member 120 such that optical axis LA of light emitting element 110 and central axis CA of light flux controlling member 120 overlap each other. Substrate 130 has reflection surface 131 which reflects light, on the surface on the side that supports light emitting element 110 and light flux controlling member 120. Reflection surface 131 may be a regular reflection surface and may also be a diffuse reflection surface.

Prism member 140 is a tubular member which is disposed so as to surround optical axis LA of light emitting element 110 including a whole of the light flux controlling member 120 and which extends in the optical axis LA direction of light emitting element 110. Prism member 140 reflects some of the reached light, thereby farther leading the light emitted from light flux controlling member 120, and also transmits some of the reached light toward diffusion member 150. The cross-sectional shape in a direction orthogonal to the long axis direction of prism member 140 is not particularly limited. A circular shape, a polygonal shape, or the like is included in an example of the cross-sectional shape of prism member 140. In this embodiment, the shape of prism member 140 is a cylindrical shape.

Substrates 130, on each of which light emitting element 110 and light flux controlling member 120 are mounted, are disposed at both opening end portions of prism member 140. Substrates 130 are disposed at both opening end portions of prism member 140 such that central axis CA1 of prism member 140, optical axis LA of light emitting element 110, and central axis CA of light flux controlling member 120 overlap each other. Here, "central axis CA1 of prism member 140" means an axis which passes through the center of the cross-sectional shape in a direction orthogonal to the long axis direction of prism member 140 and is parallel to optical axis LA of light emitting element 110.

Prism member 140 has a plurality of prism rows 141 for reflecting the light that has reached from the inside of a tube, toward the inside of the tube again. As shown in FIG. 4, the plurality of prism rows 141 is disposed parallel to optical axis LA of light emitting element 110 (central axis CA of light flux controlling member 120 and central axis CA1 of prism member 140) on the outer peripheral surface of prism member 140. The cross-sectional shape in a direction orthogonal to optical axis LA of each of the plurality of prism rows 141 is a triangular shape. Each of the plurality of prism rows 141 has a prism face which includes first plane 142 and second plane 143. First plane 142 and second plane 143 are disposed alternately in succession.

Some of the light emitted from light flux controlling member 120 is surface-reflected by the inner peripheral surface of prism member 140. The light surface-reflected by the inner peripheral surface reaches an area away from light flux controlling member 120 of prism member 140. Further, some of the light emitted from light flux controlling member 120 is incident on the inside of prism member 140 from the inner peripheral surface. Then, the light incident on the prism face at a predetermined angle, of the light incident on the inside, is reflected in the order of the first plane and the second plane (or the order of the second plane and the first plane), thereby being reflected toward the inner peripheral surface. In addition, the light incident on the prism face at an angle other than the angle at which the light is reflected by the prism face, of the light incident on the inside, is transmitted to the outside.

A material of prism member 140 is not particularly limited as long as it is a material having optical transparency. For example, a material of prism member 140 is optically-transparent resin such as polymethylmethacrylate (PMMA), polycarbonate (PC), polystyrene (PS), or styrene-methylmethacrylate copolymer resin (MS), or glass.

Diffusion member 150 is a tubular member which is located outside prism member 140, disposed so as to surround optical axis LA of light emitting element 110 and prism member 140, and extends in the optical axis LA direction of light emitting element 110. Diffusion member 150 transmits the light penetrated prism member 140 toward the outside while diffusing the light. The cross-sectional shape in a direction orthogonal to the long axis direction of diffusion member 150 is not particularly limited. A circular shape, a polygonal shape, or the like is included in an example of the cross-sectional shape of diffusion member 150. The cross-sectional shapes of prism member 140 and diffusion member 150 may be the same and may also be different from each other. In this embodiment, the shape of diffusion member 150 is a cylindrical shape.

The length of diffusion member 150 in the optical axis LA direction is the same as that of prism member 140 in the optical axis LA direction. That is, substrates 130, on each of which light emitting element 110 and light flux controlling member 120 are mounted, are also disposed at both opening end portions of diffusion member 150. Central axis CA1 of prism member 140, optical axis LA of light emitting element 110, central axis CA of light flux controlling member 120, and central axis CA2 of diffusion member 150 coincide with each other. Here, "central axis CA2 of diffusion member 150" means an axis which passes through the center of the cross-sectional shape in a direction orthogonal to the long axis direction of diffusion member 150 and is parallel to optical axis LA of light emitting element 110.

A material of diffusion member 150 is not particularly limited. For example, a material of diffusion member 150 is optically-transparent resin such as polymethylmethacrylate (PMMA), polycarbonate (PC), polystyrene (PS), or styrene-methylmethacrylate copolymer resin (MS), or glass. In order to impart a light diffusion property, fine irregularities are formed in the surface of diffusion member 150, alternatively, light diffusers such as beads are dispersed in the inside of diffusion member 150.

Prism member 140 and diffusion member 150 may be in contact with each other and may also be separated from each other. In a case where prism member 140 and diffusion member 150 are separated from each other, each of prism member 140 and diffusion member 150 has rigidity to the extent that it is possible to maintain a tubular shape.

In lighting apparatus 100 according to Embodiment 1 configured as described above, the light emitted from light emitting element 110 is emitted from emission surface 123 with light distribution made narrower by light flux controlling member 120. Then, some light that has reached prism member 140 is reflected by the inner peripheral surface or the prism face and reaches an area away from light flux controlling member 120. Further, some light that has reached prism member 140 is transmitted toward the outside of prism member 140. The light emitted from the outer peripheral surface of prism member 140 is diffused by diffusion member 150 and also emitted from the outer peripheral surface of diffusion member 150.

(Measurement of Luminance of Lighting Apparatus)

With respect to lighting apparatus 100 according to Embodiment 1, luminance distribution in the long axis direction (the optical axis LA direction of light emitting element 110) of lighting apparatus 100 was measured. Further, for comparison, also with respect to a lighting apparatus having only prism member 140 and a lighting apparatus having only diffusion member 150, luminance distribution in the long axis direction was measured. In any lighting apparatus, the length of diffusion member 150 (prism member 140 in a case where there is no diffusion member 150) is 600 mm.

Figure 5:
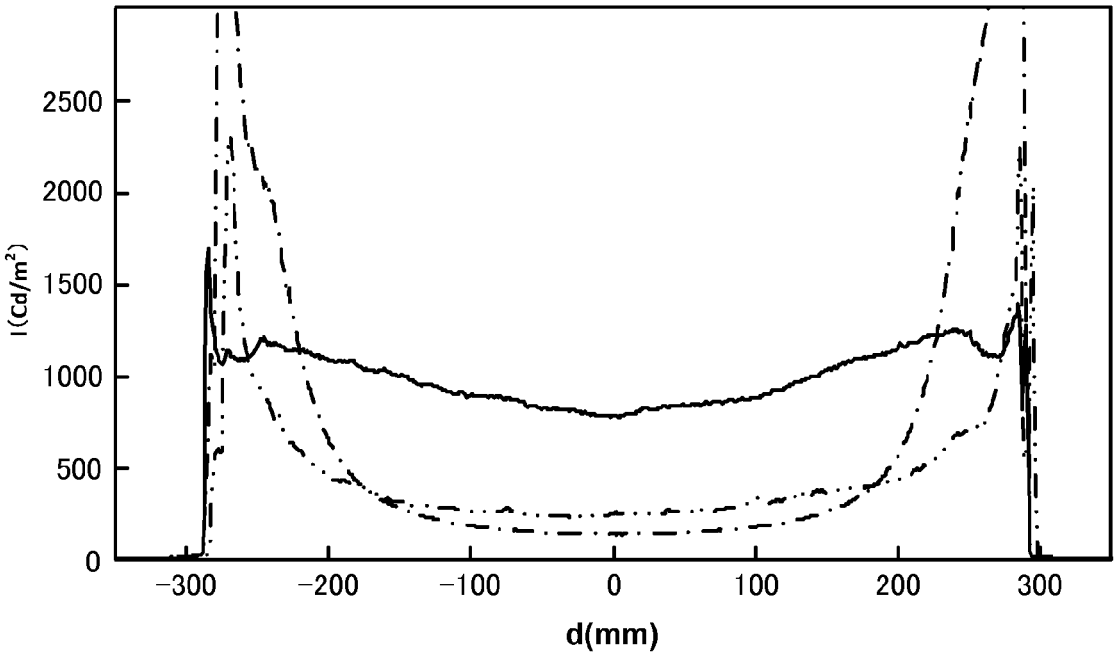
FIG. 5 is a graph showing luminance distribution in the lighting apparatus according to Embodiment 1.

FIG. 5 is a graph showing luminance distribution in each lighting apparatus. A solid line shows the luminance distribution in lighting apparatus 100 according to Embodiment 1, a dashed-dotted line shows the luminance distribution in the lighting apparatus having only prism member 140, and a two-dot chain line shows the luminance distribution in the lighting apparatus having only diffusion member 150. A horizontal axis shows a distance (mm) in the long axis direction (the optical axis LA direction of light emitting element 110) from the center, and a vertical axis shows luminance (cd/m$^2$).

As shown in FIG. 5, in the lighting apparatus for comparison having only prism member 140 which includes the plurality of prism rows 141 and the lighting apparatus for comparison having only diffusion member 150 having optical transparency and a light diffusion property, only the vicinity of light emitting element 110 becomes light.

On the other hand, in lighting apparatus 100 according to Embodiment 1 having both prism member 140 and diffusion member 150, the central portion of lighting apparatus 100 also becomes light, and thus the luminance distribution becomes uniform.

From these results, it is found that lighting apparatus 100 according to this embodiment can propagate the light emitted from light emitting element 110, to the far side, and luminance unevenness in a luminous area is small.

Modified Example

Next, lighting apparatus 200 according to a modified example of Embodiment 1 will be described. Lighting apparatus 200 according to the modified example is different from lighting apparatus 100 according to Embodiment 1 in that lighting apparatus 200 further has cover 260. Therefore, the same constituent elements as those of lighting apparatus 100 according to Embodiment 1 are denoted by the same reference signs and description thereof is omitted.

(Configuration of Lighting Apparatus)

Figure 6A:
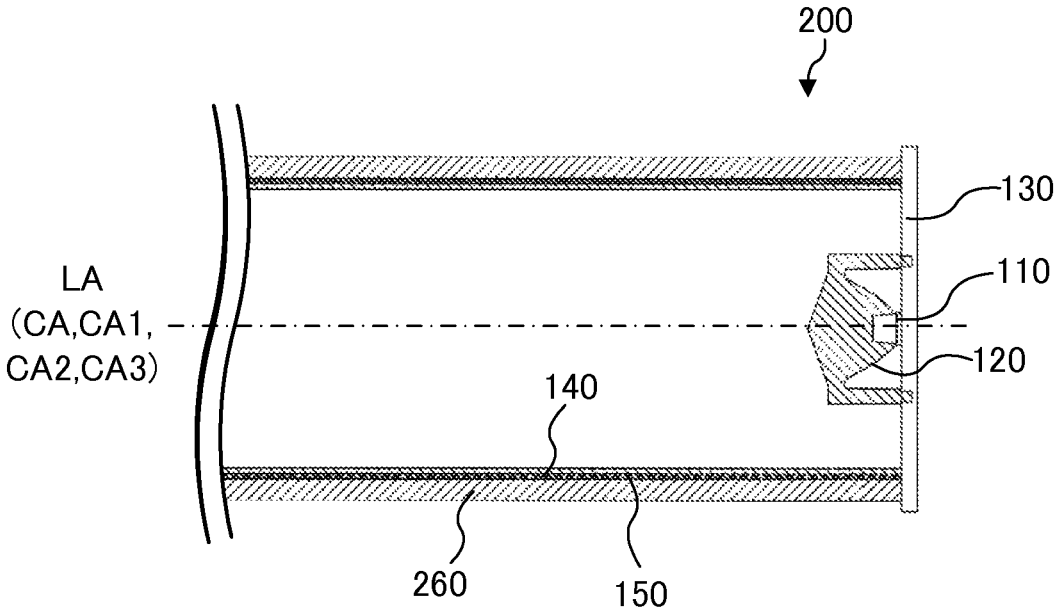
FIGS. 6A and 6B are cross-sectional views of a lighting apparatus according to a modified example of Embodiment 1.
Figure 6B:
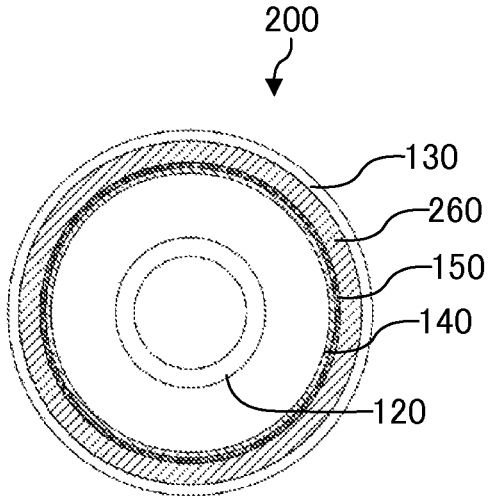

FIGS. 6A and 6B are cross-sectional views of lighting apparatus 200 according to the modified example of Embodiment 1. FIG. 6A is a partial enlarged cross-sectional view in the long axis direction (the optical axis LA direction of light emitting element 110), and FIG. 6B is a cross-sectional view in the short axis direction (a direction orthogonal to optical axis LA of light emitting element 110).

Lighting apparatus 200 has cover 260 having optical transparency, in addition to light emitting element 110, light flux controlling member 120, substrate 130, prism member 140, and diffusion member 150.

Cover 260 is a tubular member which is located outside diffusion member 150, disposed so as to surround optical axis LA of light emitting element 110, and extends in the optical axis LA direction of light emitting element 110. Cover 260 protects prism member 140 and diffusion member 150 and improves the strength of lighting apparatus 200. The cross-sectional shape in a direction orthogonal to the long axis direction of cover 260 is not particularly limited. A circular shape, a polygonal shape, or the like is included in an example of the cross-sectional shape of cover 260. In this embodiment, the shape of cover 260 is a cylindrical shape.

The length of cover 260 in the optical axis LA direction is the same as those of prism member 140 and diffusion member 150 in the optical axis LA direction. That is, substrates 130, on each of which light emitting element 110 and light flux controlling member 120 are mounted, are also disposed at both opening end portions of cover 260. Central axis CA1 of prism member 140, optical axis LA of light emitting element 110, central axis CA of light flux controlling member 120, central axis CA2 of diffusion member 150, and central axis CA3 of cover 260 coincide with each other. Here, "central axis CA3 of cover 260" means an axis which passes through the center of the cross-sectional shape in a direction orthogonal to the long axis direction of cover 260 and is parallel to optical axis LA of light emitting element 110.

A material of cover 260 is not particularly limited as long as it is a material capable of passing light having a desired wavelength. For example, a material of cover 260 is optically-transparent resin such as polymethylmethacrylate (PMMA), polycarbonate (PC), or epoxy resin (EP), or glass. Cover 260 and diffusion member 150 may be in contact with each other and need not be in contact with each other.

(Effects)

As described above, since each of lighting apparatuses 100 and 200 according to Embodiment 1 of the invention has light flux controlling member 120 which makes light distribution of the light emitted from light emitting element 110 narrower, prism member 140 which has prism rows 141 and reflects some of the light emitted from light flux controlling member 120, to the inside, and diffusion member 150 having optical transparency and a light diffusion property, it is possible to make the luminance distribution of the luminous area from the vicinity of light emitting element 110 to the far side uniform. Further, since lighting apparatuses 100 and 200 according to this embodiment have a hollow structure, it is possible to reduce weight.

Embodiment 2

Lighting apparatus 300 according to Embodiment 2 of the invention is different from lighting apparatus 100 according to Embodiment 1 in that lighting apparatus 300 further has regular reflection member 370. Therefore, the same constituent elements as those of lighting apparatus 100 according to Embodiment 1 are denoted by the same reference signs and description thereof is omitted.

(Configuration of Lighting Apparatus)

Figure 7A:
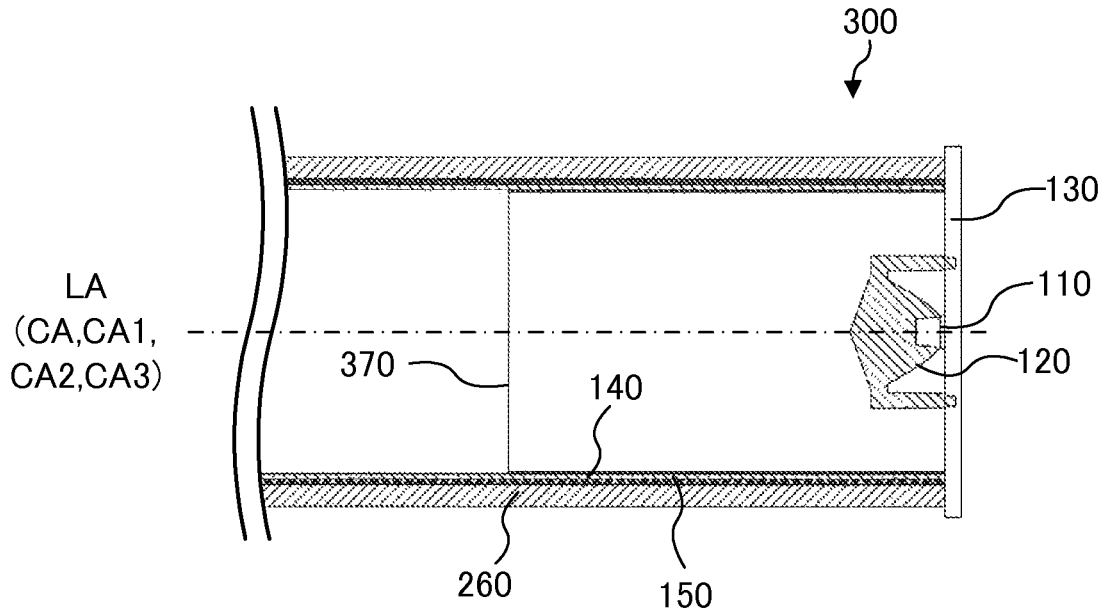
FIGS. 7A and 7B are diagrams showing the configuration of a lighting apparatus according to Embodiment 2.
Figure 7B:
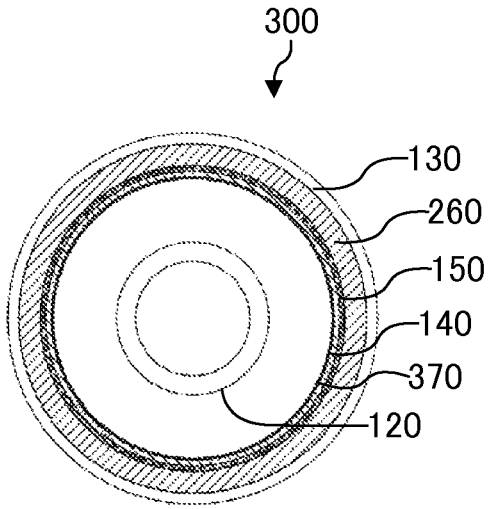

FIGS. 7A and 7B are cross-sectional views of lighting apparatus 300 according to Embodiment 2. FIG. 7A is a partial enlarged cross-sectional view in the long axis direction (the optical axis LA direction of light emitting element 110), and FIG. 7B is a cross-sectional view in the short axis direction (a direction orthogonal to optical axis LA of light emitting element 110).

Lighting apparatus 300 has regular reflection member 370 in addition to light emitting element 110, light flux controlling member 120, substrate 130, prism member 140, diffusion member 150, and cover 260.

Regular reflection member 370 is a tubular member which is disposed inside prism member 140 so as to surround light emitting element 110 and light flux controlling member 120 and extends in the optical axis LA direction of light emitting element 110. Regular reflection member 370 has a regular reflection area. The regular reflection area is disposed inside prism member 140 in a direction orthogonal to optical axis LA with respect to the light emitting device which includes light emitting element 110 and light flux controlling member 120. Specifically, the regular reflection area is surrounds the light emitting device. That is, the regular reflection area is a regular reflection surface disposed on the inner peripheral surface of the regular reflection member 370 having a tubular shape. Regular reflection member 370 reflects the light in which an emission angle with respect to optical axis LA is large, of the light emitted from light flux controlling member 120. The outer peripheral surface of regular reflection member 370 is disposed so as to come into contact with the inner peripheral surface of prism member 140. The cross-sectional shape in a direction orthogonal to the long axis direction of regular reflection member 370 is not particularly limited. A circular shape, a polygonal shape, or the like is included in an example of the cross-sectional shape of regular reflection member 370. In this embodiment, the shape of regular reflection member 370 is a cylindrical shape.

The length of regular reflection member 370 (the regular reflection area) in the optical axis LA direction is not particularly limited. However, it is preferable that the length of regular reflection member 370 be shorter than the length of prism member 140 and the length of diffusion member 150 and longer than the maximum length of the light emitting device (light emitting element 110 and light flux controlling member 120) in the optical axis LA direction. That is, it is preferable that the position of an end purport on the side opposite to light emitting element 110 of regular reflection member 370 in the optical axis LA direction be a position farther than apex 126 of at least emission surface 123 with respect to light emitting element 110. Usually, the length of regular reflection member 370 in the optical axis LA direction is less than half of the length of prism member 140 in the optical axis LA direction.

In lighting apparatus 300 according to Embodiment 2 configured as described above, the light emitted from light emitting element 110 is emitted from emission surface 123 with the light distribution made narrower by light flux controlling member 120. The light in which an emission angle with respect to optical axis LA is large to some extent, of the light emitted from emission surface 123, is reflected by the inner peripheral surface (the regular reflection area) of regular reflection member 370 and led to an area away from light flux controlling member 120. Then, the light in which an emission angle with respect to optical axis LA is small and the light reflected by the inner peripheral surface (the regular reflection area) of regular reflection member 370 reach prism member 140. The light that has reached prism member 140 is reflected toward the inside by the inner peripheral surface or the prism face or transmitted to the outside, similar to lighting apparatus 100 of Embodiment 1. The light emitted from the outer peripheral surface of prism member 140 is diffused by diffusion member 150 and also emitted from the outer peripheral surface of diffusion member 150.

(Measurement of Luminance of Lighting Apparatus)

Figure 8:
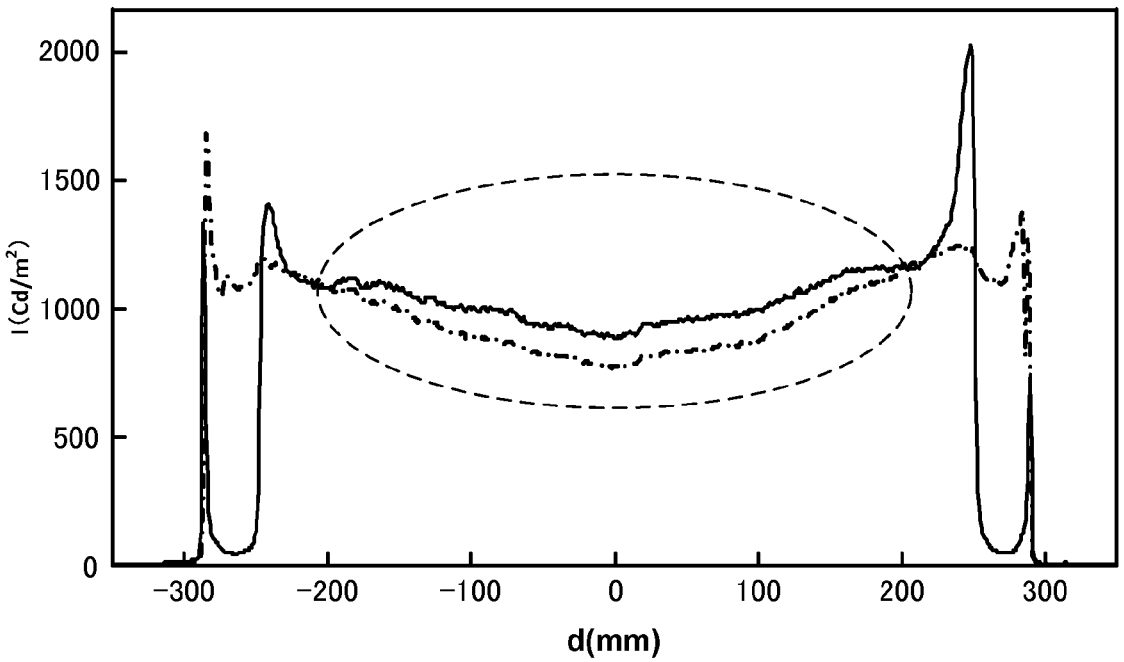
FIG. 8 is a graph showing luminance distribution in the lighting apparatus according to Embodiment 2.

With respect to lighting apparatus 300 according to Embodiment 2, luminance distribution in a length direction (the optical axis LA direction of light emitting element 110) of lighting apparatus 300 was measured. FIG. 8 is a graph showing luminance distribution in lighting apparatuses 300 and 100. In FIG. 8, a solid line shows the luminance distribution in lighting apparatus 300 according to Embodiment 2, and a dashed-dotted line shows the luminance distribution in lighting apparatus 100 according to Embodiment 1. A horizontal axis shows a distance (mm) from the center, and a vertical axis shows luminance (cd/m$^2$).

As shown in FIG. 8, in lighting apparatus 300 according to Embodiment 2 having prism member 140, diffusion member 150, and regular reflection member 370, a central portion shown by a dashed line becomes light, compared with lighting apparatus 100 according to Embodiment 1 having only prism member 140 and diffusion member 150. It is conceivable that this is because the light reflected by the inner peripheral surface (the regular reflection area) of regular reflection member 370 is propagated to the central portion.

Modified Example

Next, lighting apparatus 400 according to a modified example of Embodiment 2 will be described. Lighting apparatus 400 according to the modified example is different from lighting apparatus 300 according to Embodiment 2 in that the diameter of regular reflection member 470 differs. Therefore, the same constituent elements as those of lighting apparatus 300 according to Embodiment 2 are denoted by the same reference signs and description thereof is omitted.

(Configuration of Lighting Apparatus)

Figure 9A:
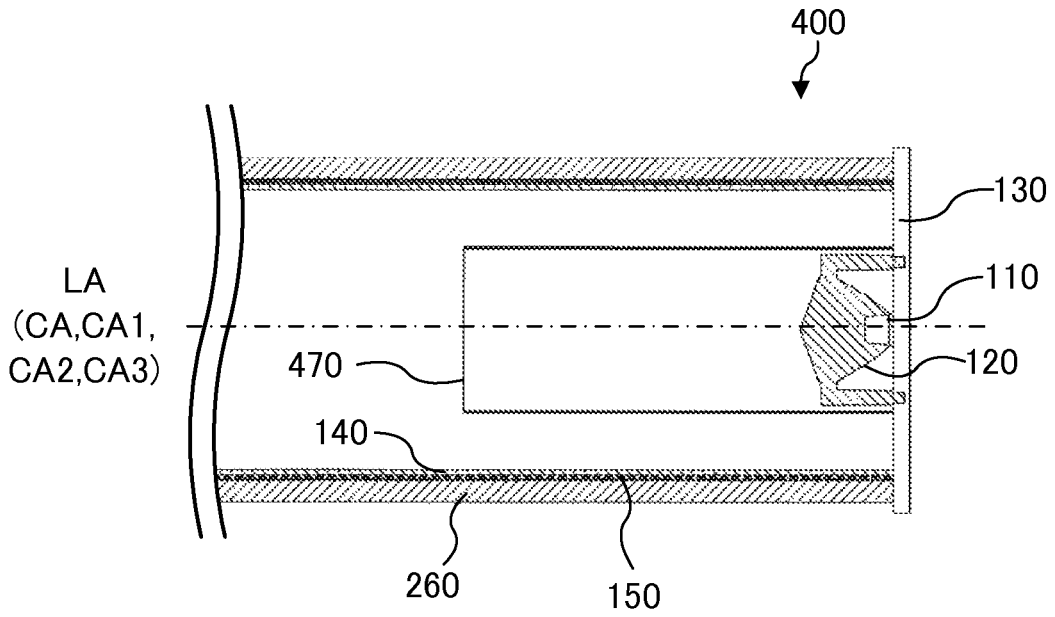
FIGS. 9A and 9B are cross-sectional views of a lighting apparatus according to a modified example of Embodiment 2.
Figure 9B:
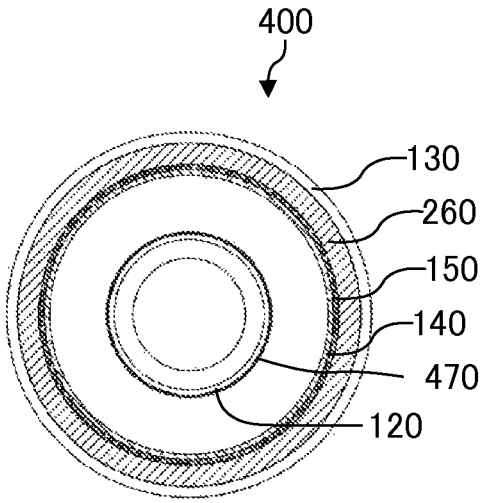

FIGS. 9A and 9B are cross-sectional views of lighting apparatus 400 according to the modified example of Embodiment 2. FIG. 9A is a partial enlarged cross-sectional view in the long axis direction (the optical axis LA direction of light emitting element 110), and FIG. 9B is a cross-sectional view in the short axis direction (a direction orthogonal to optical axis LA of light emitting element 110).

As shown in FIGS. 9A and 9B, lighting apparatus 400 has light emitting element 110, light flux controlling member 120, substrate 130, prism member 140, diffusion member 150, cover 260, and regular reflection member 470.

Regular reflection member 470 is disposed inside prism member 140. The inner peripheral surface of prism member 140 and the outer peripheral surface of regular reflection member 470 are separated from each other via a gap provided there between. Further, the inner peripheral surface and the outer peripheral surface of regular reflection member 470 are formed such that reflectance becomes high. The inner peripheral surface of regular reflection member 470 is a regular reflection surface. The outer peripheral surface of regular reflection member 470 may be a regular reflection surface and may also be a diffuse reflection surface.

It is preferable that the gap between prism member 140 and regular reflection member 470 in a cross section in a direction orthogonal to optical axis LA be formed in such a size that the light from facing light emitting element 110 reaches an end portion on the light emitting element 110 side of regular reflection member 470 and the luminance of an end portion of lighting apparatus 400 is increased by the light which has reached the gap.

In lighting apparatus 400 according to the modified example of Embodiment 2 configured as described above, the light emitted from light emitting element 110 is emitted from emission surface 123 with the light distribution made narrower by light flux controlling member 120. The light in which an emission angle with respect to optical axis LA is large to some extent, of the light emitted from emission surface 123, is reflected by the inner peripheral surface of regular reflection member 470 and led to an area away from light flux controlling member 120. Then, the light in which an emission angle with respect to optical axis LA is small and the light reflected by the inner peripheral surface of regular reflection member 470 reach prism member 140. At this time, some light enters between prism member 140 and regular reflection member 470. The light that has reached prism member 140 is reflected toward the inside by the inner peripheral surface or the prism face or transmitted to the outside, similar to lighting apparatus 100 of Embodiment 1. The light emitted from the outer peripheral surface of prism member 140 is diffused by diffusion member 150 and also emitted from the outer peripheral surface of diffusion member 150.

(Measurement of Luminance of Lighting Apparatus)

Figure 10:
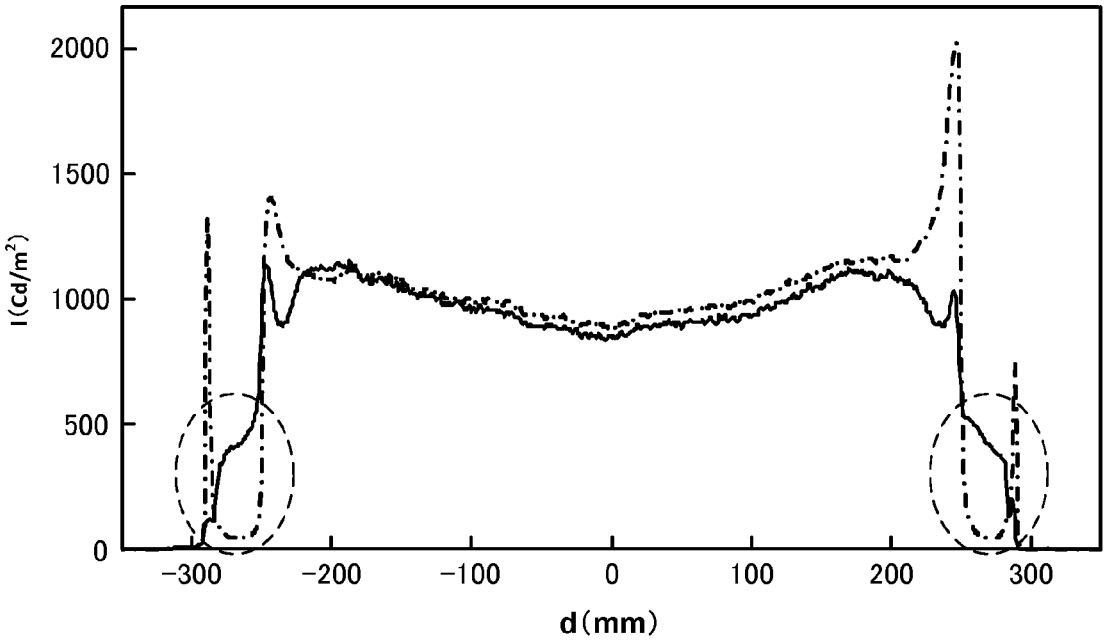
FIG. 10 is a graph showing luminance distribution in the lighting apparatus according to the modified example of Embodiment 2.

With respect to lighting apparatus 400 according to the modified example of Embodiment 2, luminance distribution in a length direction (the optical axis LA direction of light emitting element 110) of lighting apparatus 400 was measured. FIG. 10 is a graph showing luminance distribution in lighting apparatuses 400 and 300. In FIG. 10, a solid line shows the luminance distribution in lighting apparatus 400 according to the modified example of Embodiment 2, and a dashed-dotted line shows the luminance distribution in lighting apparatus 300 according to Embodiment 2. A horizontal axis shows a distance (mm) from the center, and a vertical axis shows luminance (cd/m$^2$).

As shown in FIG. 10, in lighting apparatus 400 according to the modified example of Embodiment 2 in which the inner peripheral surface of prism member 140 and the outer peripheral surface of regular reflection member 470 are separated from each other, it is found that the vicinity of light emitting element 110 (light flux controlling member 120) shown by a dashed line becomes light, compared with lighting apparatus 300 according to Embodiment 2 in which the inner peripheral surface of prism member 140 and the outer peripheral surface of regular reflection member 370 are in contact with each other. It is inferred that this is because the light from facing light emitting element 110 enters between prism member 140 and regular reflection member 470.

(Effects)

As described above, lighting apparatuses 300 and 400 according to Embodiment 2 have the same effects as those of lighting apparatuses 100 and 200 according to Embodiment 1. Further, by disposing regular refection member 370 or 470, it is possible to further brighten the central portion of lighting apparatus 300. In addition, by separating prism member 140 and regular reflection member 470, it is possible to widen a luminous area.

Embodiment 3

Lighting apparatus 500 according to Embodiment 3 of the invention is different from lighting apparatuses 300 and 400 according to Embodiment 2 in that regular reflection member 570 also plays a function as a holder of the light flux controlling member. Therefore, the same constituent elements as those of lighting apparatuses 300 and 400 according to Embodiment 2 are denoted by the same reference signs and description thereof is omitted.

(Configuration of Lighting Apparatus)

Figure 11A:
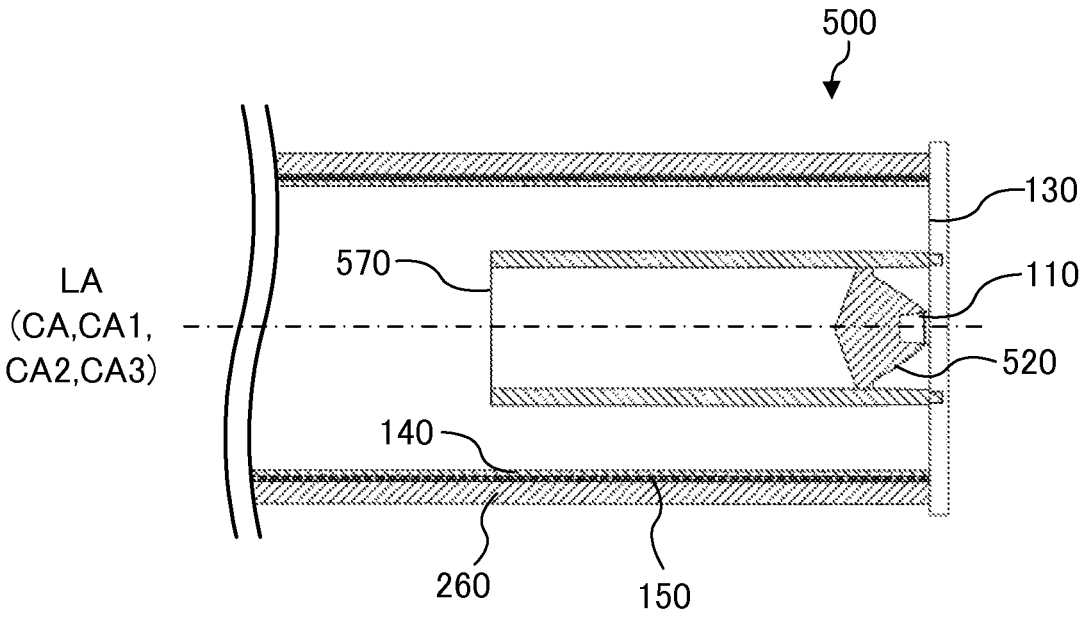
FIGS. 11A and 11B are cross-sectional views of a lighting apparatus according to Embodiment 3.
Figure 11B:
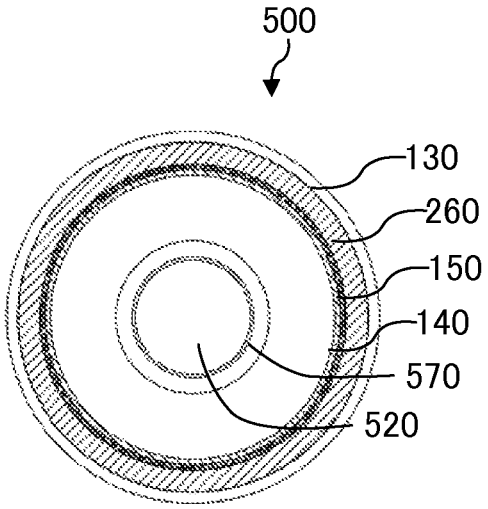

FIGS. 11A and 11B are cross-sectional views of lighting apparatus 500 according to Embodiment 3. FIG. 11A is a partial enlarged cross-sectional view in the long axis direction (the optical axis LA direction of light emitting element 110), and FIG. 11B is a cross-sectional view in the short axis direction (a direction orthogonal to optical axis LA of light emitting element 110).

As shown in FIGS. 11A and 11B, the lighting apparatus 500 has light emitting element 110, light flux controlling member 520, substrate 130, prism member 140, diffusion member 150, and regular reflection member 570.

Light flux controlling member 520 according to Embodiment 3 has incidence plane 121, total reflection surface 122, emission surface 123, and flange 124. That is, light flux controlling member 520 of this embodiment does not have a holder.

Regular reflection member 570 is a substantially cylindrical member. Regular reflection member 570 supports light flux controlling member 520 in addition to the function shown in Embodiment 2. Light flux controlling member 520 is disposed on the substrate 130 side of the inside of regular reflection member 570. The diameter of the inner peripheral surface of regular reflection member 570 is the same as the diameter of the outer peripheral surface of flange 124. The outer peripheral surface of flange 124 is joined to the inner peripheral surface of regular reflection member 570. Accordingly, in regular reflection member 570, a portion further on the substrate 130 side than flange 124 functions as a holder. On the other hand, a portion on the opposite side functions as a reflection tube.

In lighting apparatus 500 according to Embodiment 3 configured as described above, light distribution is controlled in the same way as lighting apparatus 400 according to the modified example of Embodiment 2.

(Effects)

As described above, lighting apparatus 500 according to Embodiment 3 has the same effects as those of lighting apparatuses 100, 200, 300, and 400 according to Embodiments 1 and 2. Further, regular reflection member 570 combines a function of a holder, whereby it is possible to further reduce weight.

Embodiment 4

Lighting apparatus 600 according to Embodiment 4 of the invention is different from lighting apparatuses 300 and 400 according to Embodiment 2 in that the regular reflection area is not disposed in a tubular shape. Therefore, the same constituent elements as those of lighting apparatuses 300 and 400 according to Embodiment 2 are denoted by the same reference signs and description thereof is omitted.

(Configuration of Lighting Apparatus)

Figure 12A:
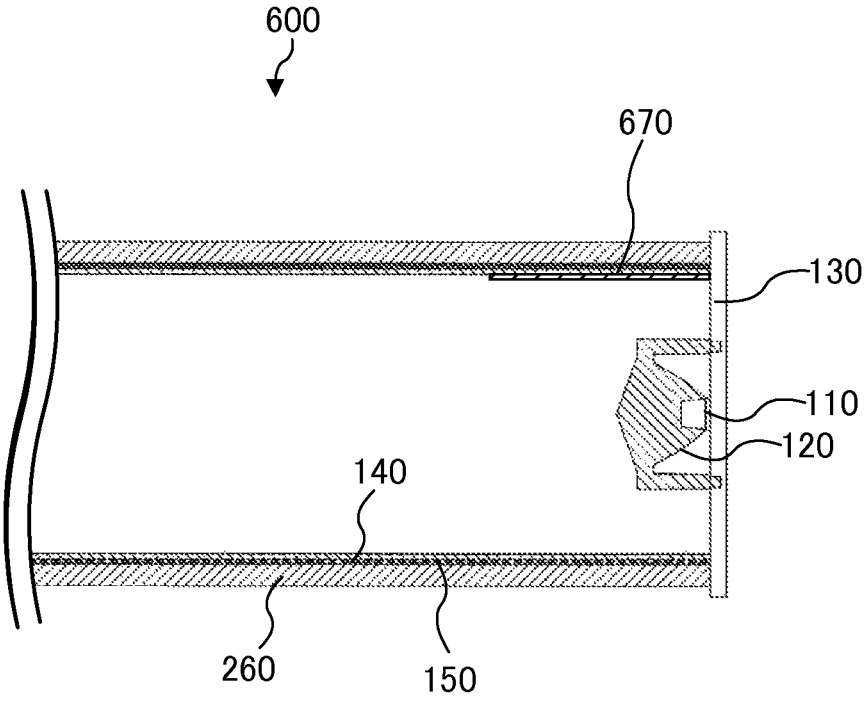
FIGS. 12A and 12B are cross-sectional views of a lighting apparatus according to Embodiment 4.
Figure 12B:
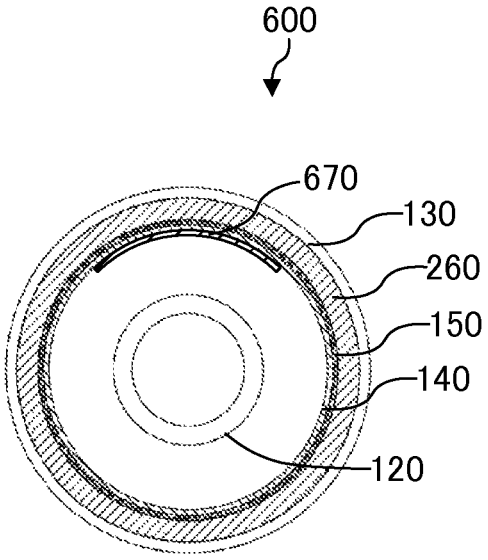

FIGS. 12A and 12B are cross-sectional views of lighting apparatus 600 according to Embodiment 4. FIG. 12A is a partial enlarged cross-sectional view in the long axis direction (the optical axis LA direction of light emitting element 110), and FIG. 12B is a cross-sectional view in the short axis direction (a direction orthogonal to optical axis LA of light emitting element 110).

As shown in FIGS. 12A and 12B, lighting apparatus 600 has light emitting element 110, light flux controlling member 120, substrate 130, prism member 140, diffusion member 150, and regular reflection member 670.

Regular reflection member 670 is a curved plate-shaped (partially cylindrical) member. A regular reflection area is disposed on the inner peripheral surface of regular reflection member 670. In this case, the regular reflection area is the entire surface of the inner peripheral surface of regular reflection member 670. The length of the regular reflection area in the optical axis LA direction is not particularly limited. However, it is preferable that the length of the regular reflection area be longer than the maximum length of the light emitting device (light emitting element 110 and light flux controlling member 120) in the optical axis LA direction. Usually, the length of the regular reflection area in the optical axis LA direction is less than half of the length of prism member 140 in the optical axis LA direction.

(Effects)

In lighting apparatus 600 according to Embodiment 4 configured as described above, since the regular reflection area is disposed at a portion of the side (in a direction orthogonal to optical axis LA) of the light emitting device, in addition to the same effects as those of lighting apparatuses 100 and 200 according to Embodiment 1, it is possible to increase the amount of light in the vicinity of light emitting element 110 and on the side where the regular reflection area is not disposed.

Embodiment 5

Lighting apparatus 700 according to Embodiment 5 of the invention is different from lighting apparatus 200 according to the modified example of Embodiment 1 in that it has a lacking portion that extends over the entire length thereof along the optical axis LA of each of prism member 740, diffusion member 750, and cover 760. Therefore, the same constituent elements as those of lighting apparatus 200 according to the modified example of Embodiment 1 are denoted by the same reference signs and description thereof is omitted.

(Configuration of Lighting Apparatus)

Figure 13A:
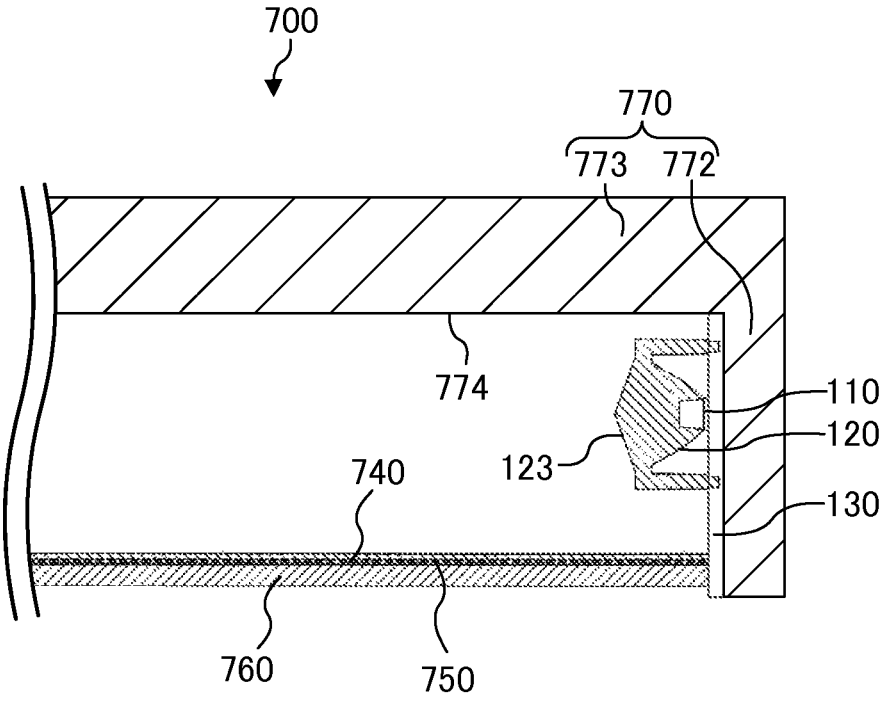
FIGS. 13A and 13B are cross-sectional views of a lighting apparatus according to Embodiment 5.
Figure 13B:
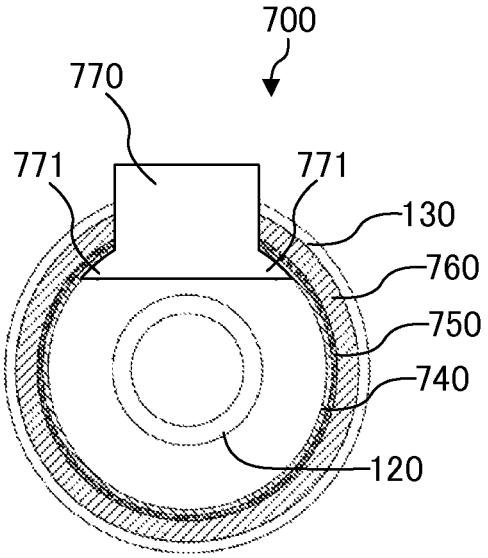

FIGS. 13A and 13B are cross-sectional views of lighting apparatus 700 according to Embodiment 5. FIG. 13A is a partial enlarged cross-sectional view in the long axis direction (the optical axis LA direction of light emitting element 110), and FIG. 13B is a cross-sectional view in the short axis direction (a direction orthogonal to optical axis LA of light emitting element 110).

As shown in FIGS. 13A and 13B, lighting apparatus 700 has light emitting element 110, light flux controlling member 120, substrate 130, prism member 740, diffusion member 750, cover 760, and base 770. That is, lighting apparatus 700 according to this embodiment does not have a tubular regular reflection member.

Prism member 740 is formed into a substantially cylindrical shape in which it lacks a portion in a circumferential direction of a peripheral wall of a cylinder over the entire length of the cylinder. For example, side edge portions of prism member 740 are fitted to a pair of protrusions 771 of side edges of base 770, whereby prism member 740 is mounted on base 770.

Diffusion member 750 is formed into a substantially cylindrical shape in which it lacks a portion in a circumferential direction of a peripheral wall of a cylinder over the entire length of the cylinder. For example, side edges of diffusion member 750 are fitted to protrusions 771 of side edges of base 770, whereby diffusion member 750 is mounted on base 770 with prism member 740 mounted thereon.

Cover 760 is formed into a substantially cylindrical shape wherein the circumferential surface thereof has a lacking portion that extends over the entire length of the cylinder. For example, side edges of cover 760 are fitted to the pair of protrusions 771 of side edges of base 770, whereby cover 760 is mounted on base 770 with prism member 740 and diffusion member 750 mounted thereon.

That is, all of prism member 740, diffusion member 750, and cover 760 are formed into a substantially cylindrical shape. When being mounted on base 770, prism member 740, diffusion member 750, and cover 760 may be assembled and then mounted on base 770 and may also be mounted in order, as described above.

Base 770 supports light emitting element 110, light flux controlling member 120, substrate 130, prism member 740, diffusion member 750, and cover 760. Base 770 has a pair of substrate fixing portions 772 and cover fixing portion 773.

Substrate fixing portion 772 supports substrate 130 with light emitting element 110 and light flux controlling member 120 mounted thereon. Substrate fixing portions 772 are disposed at both ends of lighting apparatus 700. Substrate fixing portion 772 disposes substrate 130 such that emission surface 123 of light flux controlling member 120 faces the opposite side. Further, substrate fixing portion 772 may have the function of a heat sink. That is, substrate fixing portion 772 can also cool light emitting element 110 through substrate 130.

Cover fixing portion 773 supports prism member 740, diffusion member 750, and cover 760. Cover fixing portion 773 is formed in the same length as those of prism member 740, diffusion member 750, and cover 760. Protrusions 771 with which prism member 740, diffusion member 750, and cover 760 are engaged are disposed at both edge portions parallel to optical axis LA of cover fixing portion 773. Further, a regular reflection area is disposed on the surface facing light flux controlling member 120 of cover fixing portion 773.

(Effects)

In lighting apparatus 700 according to Embodiment 5 configured as described above, each of prism member 740, diffusion member 750, and cover 760 has a lacking portion that extends over the entire length thereof along optical axis LA and the regular reflection area is disposed parallel to optical axis LA, in addition to the same effects as those of lighting apparatuses 100 and 200 according to Embodiment 1. Therefore, it is possible to increase the amount of light in the vicinity of light emitting element 110 and on the side where the regular reflection area is not disposed.

In addition, in each embodiment described above, the lighting apparatus in which the light emitting elements are respectively disposed at both opening end portions of the prism member has been described. However, the light emitting element may be disposed at only the opening end portion on one side of the prism member. In this case, it is preferable that the surface of the substrate on the side where the light emitting element is not disposed be a regular reflection surface.

INDUSTRIAL APPLICABILITY

The lighting apparatus according to the invention can be widely applied to various types of lighting equipment because it can be used in place of a fluorescent tube or the like.

REFERENCE SIGNS LIST

10, 100, 200, 300, 400, 500, 600, 700 Lighting apparatus
20 Light source
30 Light guide member
40, 260, 760 Cover
110 Light emitting element
120, 520 Light flux controlling member
121 Incidence plane
122 Total reflection surface
123 Emission surface
124 Flange
125 Holder
126 Apex
130 Substrate
131 Reflection surface
140, 740 Prism member
141 Prism row
142 First plane
143 Second plane
150, 750 Diffusion member
370, 470, 570, 670 Regular reflection member
770 Base
771 Protrusion
772 Substrate fixing portion
773 Cover fixing portion

The invention claimed is:

1. A lighting apparatus comprising:

two light emitting devices, each of which includes a light emitting element and a light flux controlling member which is disposed such that a central axis thereof overlaps with an optical axis of the light emitting element, and the light flux controlling member being configured to control a light from the light emitting element so as to narrow light distribution of the light, and the light emitting devices being disposed facing each other such that emission surfaces of the light flux controlling members face each other with a continuous volume of air therebetween;

two substantially tubular reflection members, each of which is a hollow tube, are disposed so as to surround each one of the light emitting devices, and has reflection surfaces disposed on both an inner peripheral surface and an outer peripheral surface thereof;

a substantially tubular prism member which is disposed so as to surround the optical axis, the light emitting devices and the regular reflection members, is formed of an optically-transparent material, has a plurality of prism rows, and extends in the optical axis direction; and a substantially tubular diffusion member which is disposed so as to surround the prism member and has optical transparency and a light diffusion property, wherein the plurality of prism rows is disposed parallel to the optical axis on an outer peripheral surface of the prism member, a length of each of the reflection members in the optical axis direction is shorter than the prism member and the diffusion member and longer than the maximum length of the light emitting device in the optical axis direction, light emitted from the light emitting element is emitted through the prism member and the diffusion member, the reflection member and the prism member are separated from each other via a gap provided therebetween, at least a part of the diffusion member corresponding to the light flux controlling member serves as a light emission region.

2. The lighting apparatus according to claim 1, wherein each of the reflection members supports one of the light flux controlling members.

3. The lighting apparatus according to claim 1, wherein each of the prism member and the diffusion member has a lacking portion that extends over the entire length thereof along the optical axis direction.

4. The lighting apparatus according to claim 1, further comprising:

a substantially tubular cover which is disposed so as to surround the diffusion member and has optical transparency.

5. The lighting apparatus according to claim 1, wherein the light emitting element is disposed on a substrate having a reflection surface.

6. The lighting apparatus according to claim 1, wherein the light flux controlling member has:

an incidence plane which is formed on a back side so as to intersect with the central axis and on which light emitted from the light emitting element is incident;

a total reflection surface which surrounds the central axis, is formed such that a diameter is gradually enlarged toward a front side from the back side, and reflects some of light incident on the incidence plane toward the front side; and an emission surface which is formed on the front side so as to intersect with the central axis and emits some of light incident on the incidence plane and light reflected by the total reflection surface to the outside.

* * * * *